US009599924B2

(12) United States Patent
Mandai et al.

(10) Patent No.: US 9,599,924 B2
(45) Date of Patent: Mar. 21, 2017

(54) DEVELOPING DEVICE AND IMAGE FORMING APPARATUS

(71) Applicant: Konica Minolta, Inc., Chiyoda-ku, Tokyo (JP)

(72) Inventors: Yuusuke Mandai, Kyoto (JP); Yasuyuki Inada, Toyohashi (JP); Yu Mukobayashi, Nagoya (JP); Shinichi Yoshimoto, Toyohashi (JP); Junji Kanda, Toyota (JP); Kanji Nakayama, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/063,597

(22) Filed: Mar. 8, 2016

(65) Prior Publication Data

US 2016/0274488 A1 Sep. 22, 2016

(30) Foreign Application Priority Data

Mar. 19, 2015 (JP) ..... 2015-055625

(51) Int. Cl.
*G03G 15/09* (2006.01)
*G03G 15/06* (2006.01)

(52) U.S. Cl.
CPC ..... *G03G 15/065* (2013.01); *G03G 15/0907* (2013.01); *G03G 2215/0132* (2013.01)

(58) Field of Classification Search
CPC ..... G03G 15/065; G03G 15/0907; G03G 2215/0132
USPC ..... 399/53, 55
See application file for complete search history.

(56) References Cited

U.S. PATENT DOCUMENTS 4,376,813 A * 3/1983 Yuge ..... G03G 15/0907 399/270
4,398,817 A * 8/1983 Nishimura ..... G03G 15/0126 399/225
4,626,096 A * 12/1986 Ohtsuka ..... G03G 15/065 399/55 X

FOREIGN PATENT DOCUMENTS

JP H05107903 A 4/1993
JP 2007-233205 A 9/2007

OTHER PUBLICATIONS

Office Action issued on Jan. 31, 2017, by the Japanese Patent Office in corresponding Japanese Patent Application No. 2015-055625 and an English translation of the Office Action. (6 pgs).

* cited by examiner

*Primary Examiner* — Sophia S Chen
(74) *Attorney, Agent, or Firm* — Buchanan Ingersoll & Rooney PC

(57) ABSTRACT

There are provided a developing device including a developing roller to develop an image carrier by use of a two-component developer and a developing bias power source, and an image forming apparatus using the developing device. The developing device further includes a variable resistance unit provided on a bias apply path to apply a bias from the developing power source to the developing roller, and a resistance controller to control a resistance value of the variable resistance unit based on a charge amount signal indicating a toner's charge amount in a developer layer on the developing roller. The resistance controller provides a low mode to lower the resistance of the variable resistance unit and a high mode to enhance the resistance. The low mode is set if the toner charge amount is low, and the high mode is set if the toner charge amount is high.

20 Claims, 9 Drawing Sheets

FIG. 6

NN ENVIRONMENT
10K/DAY
COVERAGE OF 5%

| MODE | 1ST DAY | 2ND DAY | 3RD DAY |
|---|---|---|---|
| LOW MODE | B | C | – |
| HIGH MODE | B | B | B |

FIG. 7

| NUMBER OF DAYS | ENVIRONMENT | NUMBER OF PRINTED SHEETS PER DAY (k SHEETS) | AVERAGE NUMBER OF PRINTED SHEETS PER DAY (k SHEETS / DAY) |
|---|---|---|---|
| 1ST DAY | LL | 5.0 | – |
| | NN | 10.0 | – |
| | HH | 13.0 | – |
| 2ND DAY | LL | 4.0 | 4.5 |
| | NN | 8.0 | 9.0 |
| | HH | 10.0 | 11.5 |
| 3RD AND SUBSEQUENT DAY(S) | LL | 3.0 | 4.0 |
| | NN | 6.0 | 8.0 |
| | HH | 8.0 | 10.3 |

DEVELOPING DEVICE AND IMAGE FORMING APPARATUS

CROSS-REFERENCE TO RELATED APPLICATIONS

This application is based upon and claims the benefit of priority from the prior Japanese Patent Application No. 2015-055625, filed Mar. 19, 2015, the entire contents of which are incorporated herein by reference.

BACKGROUND OF THE INVENTION

Field of the Invention

The present invention relates to a developing device using a two-component developer and an image forming apparatus using the developing device. More specifically, the present invention relates to a developing device and an image forming apparatus using the same which are configured to cope with an increase in a charge amount of toner in use.

Related Art

Conventionally, image forming apparatuses using toner as a color former have been used. In the toner-type image forming apparatuses, when image forming is to be performed, the toner is agitated (stirred) to be frictionally charged, and the charged toner is transferred from a developing roller onto a photoconductor by a developing bias so that a latent image on the photoconductor is developed to be formed as a visible image. In an image forming apparatus having the above configuration, a charge amount of the stored toner tends to increase when image forming jobs are frequently performed and the amount tends to decrease during non-image forming period.

Among the toner-type image forming apparatuses, especially, a conventional example in which toner and carrier are used as a two-component developer has been described in Patent Document 1. An image forming apparatus described in the document adopts a conductive agitating member for agitating a developer. Further, it is described in the document that a bias is applied between a developing roller (a developing sleeve in the document) and the agitating member. Thus, the apparatus in Patent Document 1 is targeted to efficiently remove electric charge of the carrier and prevent charge failure in the toner.

RELATED ART DOCUMENTS

Patent Documents

Patent Document 1: JP-A-2007-233205

SUMMARY OF INVENTION

Problems to be Solved by the Invention

In recent years, high productivity of image forming has been demanded more for image forming apparatuses, and the number of sheets to be printed per hour by apparatus especially for business use tends to increase. Moreover, it has been demanded to assure the maximum number of printable sheets per month at a high level. If the number of printable sheets per month is large, the number of printable sheets per each working day is also large. Under such a high duty circumstance that an apparatus prints a large number of sheets per day, a halt or non-operating time of the apparatus is short on the contrary. Therefore, as mentioned above, the charge amount of the toner is apt to be increased. This tendency becomes further noticeable when most images to be formed are low-coverage images. This is because during the low-coverage image forming, less toner is consumed and replaced. In a state in which the charge amount of the toner is excessive, there is a problem that a developing performance of the toner is low and the formed image is likely to have uneven density.

A conventional measure to address those problems is conceived to adjust a mixture ratio of toner and carrier such that more toner is contained. However, this method has a problem that the toner could be scattered. The increased mixture ratio of toner leads to increase in a toner amount included in a developer layer on a developing roller, causing scattering of the toner from the roller. In association with the recent acceleration of image forming, the toner scattering is further likely to occur. This is because the developing roller is rotated at high speed, and thus the developer layer is subjected to a large centrifugal force. Further, this method only achieves an effect of reducing the increasing speed of the toner charge amount. Therefore, if a printing job for a large amount of low-coverage images continues, the toner charge amount could be increased after all.

Another conventional measure is to apply a patch image, namely, to form a dummy image on the photoconductor. Specifically, the toner with the increased charge amount is forcibly ejected by forming dummy images, and new toner as much as the ejected toner is replenished so that a toner's average charge amount is reduced. However, this method results in waste toner other than the toner used naturally for image forming jobs. Accordingly, a large amount of toner for replenishment is to be required. In particular, when a printing job for a low-coverage image with less natural toner consumption is performed, more patch images are necessary to be formed, so that there is a possibility that the waste toner used for the patch image forming becomes larger than the toner amount naturally used for the image printing jobs.

The present invention has been made to solve the problems of the conventional technique mentioned above. Specifically, the present invention has a purpose of providing a developing device using a two-component developer and an image forming apparatus using the developing device which enable to effectively restrain uneven density of an image due to increase in a toner charge amount under the high-duty circumstance and prevent unnecessary consumption of the toner.

Means of Solving the Problems

To achieve at least one of the abovementioned objects, a developing device reflecting one aspect of the present invention comprises: a developing roller configured to carry a two-component developer on its surface to develop an electrostatic latent image on an image carrier; and a developing bias power source to apply a developing bias to the developing roller, wherein the developing device further includes: a variable resistance unit provided on a bias applying path through which the bias is applied to the developing roller from the developing bias power source, the variable resistance unit being configured to selectively obtain a resistance value at two or more levels; and a resistance control unit to control the resistance value of the variable resistance unit based on a charge amount signal indicating a toner's charge amount in the two-component developer which is carried on the developing roller, the resistance control unit controls the resistance value in one of two control modes including: a low mode to reduce the resistance value of the variable resistance unit; and a high mode to enhance the resistance value of the variable resistance unit, the low mode is selected if the toner's charge amount represented by the charge amount signal is low, and the high mode is selected if the toner's charge amount represented by the charge amount signal is high.

In the developing device according to the above aspect, if the toner charge amount is low, image forming is performed in the low mode to lower the resistance value of the variable resistance unit. In the low mode, the toner charge is not restrained, and thus image forming failure due to shortage in toner charge rarely happens. However, if the toner charge amount is high, image forming is performed in the high mode to enhance the resistance value of the variable resistance unit. In the high mode, the electric current flowing between the developing bias power source and the developing roller is restrained further than in the low mode. This restraint of the current flow acts on a discharge current when it is assumed that a total current flow between the developing bias power source and the developing roller is divided into a developing current corresponding to a toner transfer amount in association with a developing operation and a discharge current to discharge the charged carrier which remains in the developer layer after the developing operation. Thus, the carrier is placed in the charged state in a reversed polarity from a polarity of the toner charge. The toner charge is thus restrained. Accordingly, when the toner charge amount is likely to be excessive, the high mode is favorable. The image forming in the high mode can expect reduction of the excess charge of the toner.

Effects of the Invention

According to the present configuration, there are provided a developing device using a two-component developer and an image forming apparatus using the developing device, both of which enable to effectively restrain density unevenness of an image caused by an increase in a toner charge amount and prevent unnecessary consumption of the toner even in a high-duty circumstance.

BRIEF DESCRIPTION OF THE DRAWINGS

FIG. 6 is a table showing a result of the endurance test to compare the occurrence situation of the density unevenness between the low mode and the high mode;

FIG. 7 is a table showing threshold values of the number of printed sheets for switching modes in the first embodiment;

DESCRIPTION OF EMBODIMENTS

A detailed description of embodiments embodying the present invention will be given below with reference to the accompanying drawings. The present embodiments are applied with the present invention as an image forming apparatus to form an image by use of a two-component developer.

Figure 1:
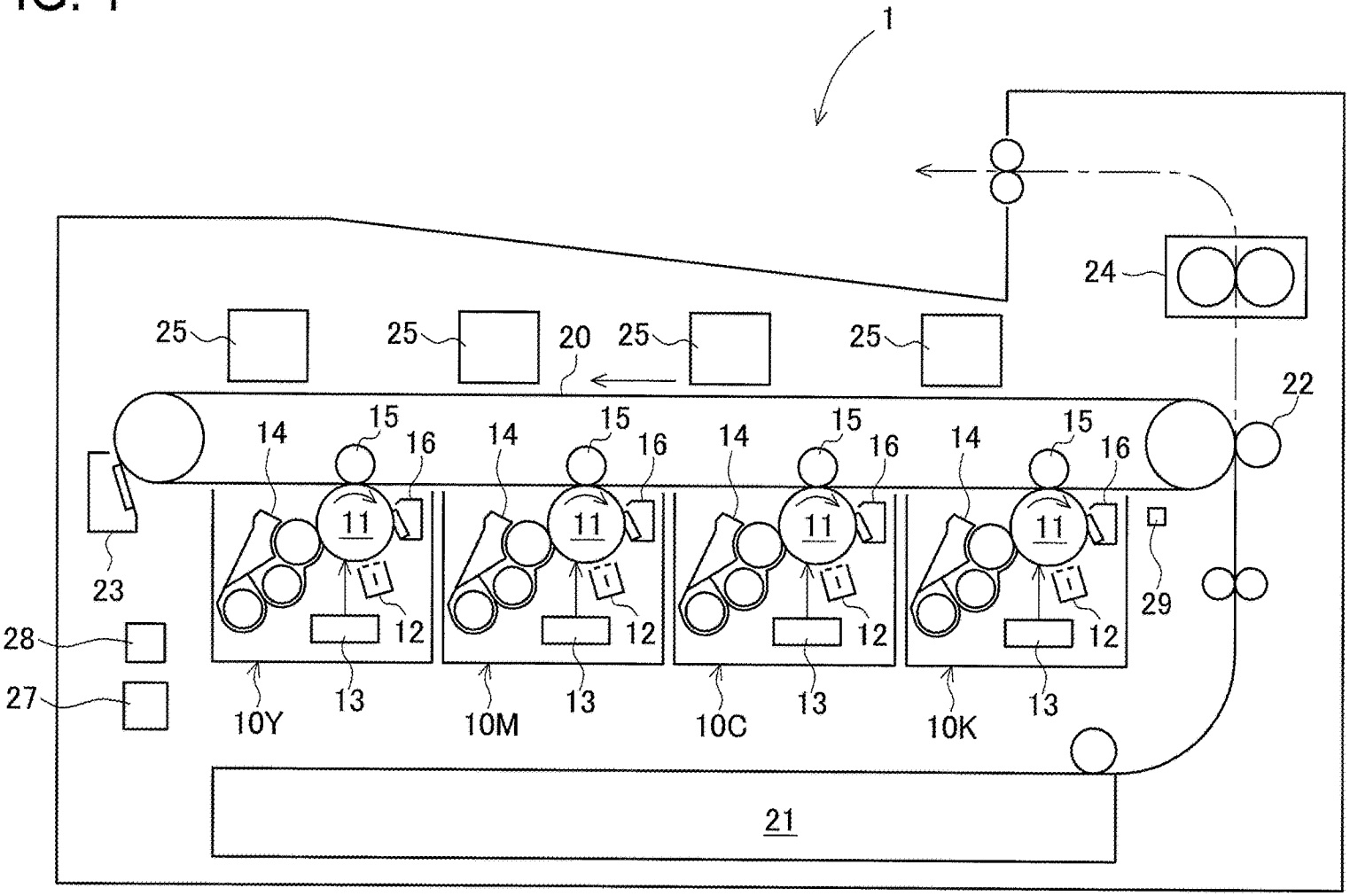
FIG. 1 is a schematic configuration of an image forming apparatus in embodiments.

An image forming apparatus 1 of the present embodiments is, as shown in FIG. 1, a so-called tandem image forming apparatus in which image forming units 10Y, 10M, 10C, and 10K for each color are arranged along an intermediate transfer belt 20. The image forming units are respectively provided with a photoconductor 11, a charger 12, an exposing device 13, a developing device 14, a primary transfer part 15, and a cleaner 16. Further, under the image forming units in the figure, a sheet feeding unit 21 is placed. Other than the above components, the image forming apparatus 1 of the present embodiments includes a secondary transfer part 22, a belt cleaner part 23, a fixing part 24, toner hoppers 25 for each color, and others.

The image forming apparatus 1 in FIG. 1 is further provided with an environment sensor 27, a general controller 28, and an image density sensor 29. The environment sensor 27 is used to detect temperature and humidity in the apparatus. A signal detected by the sensor 27 is to be sent to the general controller 28. The general controller 28 is configured to comprehensively control various operations such as an image forming operation in the image forming apparatus 1. The image density sensor 29 is a sensor to optically measure a density of a toner image on the intermediate transfer belt 20. The image density sensor 29 in the present embodiments is used in "a second embodiment" which will be explained later.

During image forming by the image forming apparatus 1 of the present embodiments, a toner image with each color is formed on each photoconductor 11 in the image forming units 10Y, 10M, 10C, and 10K for each color. Namely, each photoconductor 11 is uniformly charged by the charger 12. Subsequently, an electrostatic latent image is formed on a surface of each photoconductor 11 by the exposing unit 13. A developer is then supplied to the electrostatic latent image by the developing device 14, and thus a visible toner image is formed. Further, the toner images with each color are transferred and overlaid on the intermediate transfer belt 20 by the primary transfer part 15. The thus overlaid toner image is further transferred onto a sheet which is fed from the sheet feeding unit 21 by the secondary transfer part 22 and fixed on the sheet by the fixing part 24.

First Embodiment

Figure 2:
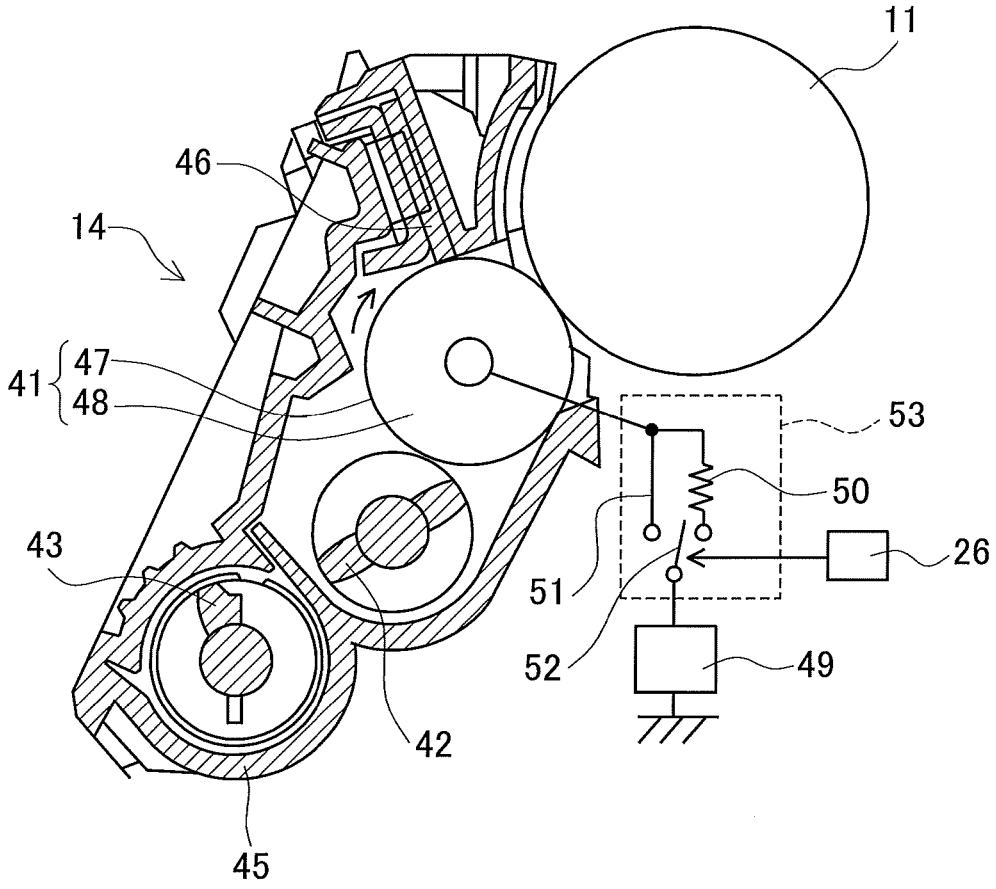
FIG. 2 is a configurational sectional view of a developing device in a first embodiment.

The developing device 14 in the first embodiment includes, as shown in FIG. 2, a developing roller 41, a supply screw propeller 42, and a stirring screw propeller 43. These components are placed in parallel to one another inside a housing 45. In the housing 45, a developer comprising toner and carrier is stored. The toner in the present embodiment is negatively electrified (charged). The developer is agitated while being conveyed by the supply screw propeller 42 and the stirring screw propeller 43 in their axial directions (in a depth direction in the figure), blades of the supply screw propeller 42 and the stirring screw propeller 43 being placed at a slant. In the housing 45, a regulation blade 46 is also provided. The regulation blade 46 is arranged to regulate a thickness of a developer layer which carried on a surface of the developing roller 41 and to charge the developer by friction.

The developing roller 41 is configured with a rotatable cylindrical developing sleeve 47 and a magnet member 48 which is placed statically inside the developing sleeve 47. The magnet member 48 is formed with magnetic poles as described in FIG. 1 of Japanese Patent Application Publication No. 2009-151135, for example. These magnetic poles are to perform capture and exfoliation of the developer on the surface of the developing roller 41 (precisely, on a surface of the developing sleeve 47). In the following explanation, the developing sleeve 47 and the magnet member 48 as a whole is to be called as the developing roller 41 unless there is any specific reason to separately specify them.

The developing roller 41 is attached (connected) with a developing bias power source 49. The developing bias power source 49 is used to apply to the developing roller 41 a developing bias for developing an electrostatic latent image on the photoconductor 11. In the present embodiment, the developing bias power source 49 applies the developing bias in which alternating-current (AC) component is superimposed with direct-current (DC) component.

On a path to apply a bias to the developing roller 41 from the developing bias power source 49, a fixed resistor 50 and a bypass path 51 bypassing (detouring) the fixed resistor 50 are provided. Further, there is provided a switch 52 to selectively make operative any one of the fixed resistor 50 and the bypass path 51. The fixed resistor 50, the bypass path 51, and the switch 52 constitute a variable resistance unit 53. The fixed resistor 50 is set with a fixed resistance value. The resistance value of the fixed resistor 50 is preferably, for example, about 10 to 150 (MΩ). Further, a resistor controller 26 to operate the switch 52 is provided. The developing bias power source 49, the variable resistance unit 53, and the resistor controller 26 may be common for the developing devices 14 for plural colors. Especially, the resistor controller 26 may be a part of the general controller 28.

It is now explained the difference in current flowing between the developing roller 41 and the developing bias power source 49 according to a state of the variable resistance unit 53 during image forming by the developing device 14. The state of the variable resistance unit 53 corresponds to a state of the switch 52. Specifically, the variable resistance unit 53 has one state in which the bypass path 51 is operative and the other state in which the fixed resistor 50 is operative. The former state (a low mode) is shown in FIG. 3 and the latter state (a high mode) is shown in FIG. 4.

Figure 3:
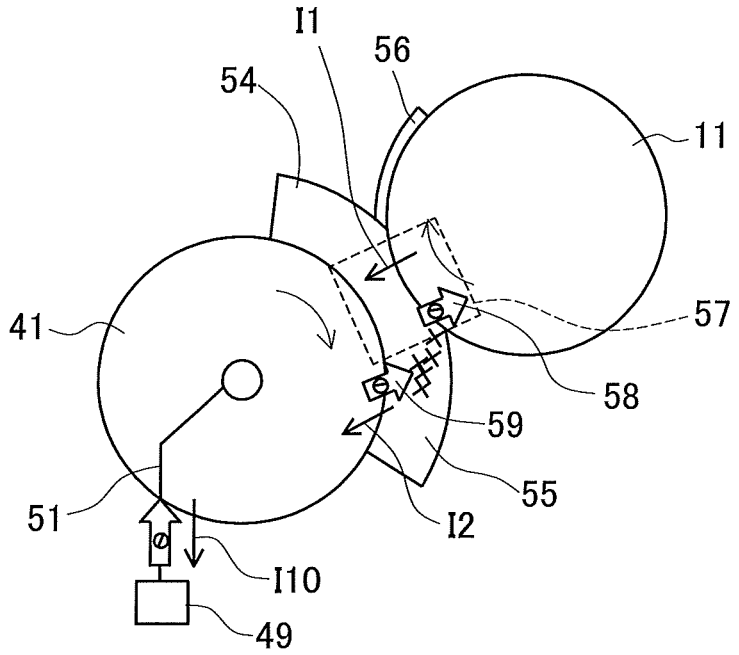
FIG. 3 is a diagram for explaining a developing current flow when a resistor is not used (in a low mode)
Figure 4:
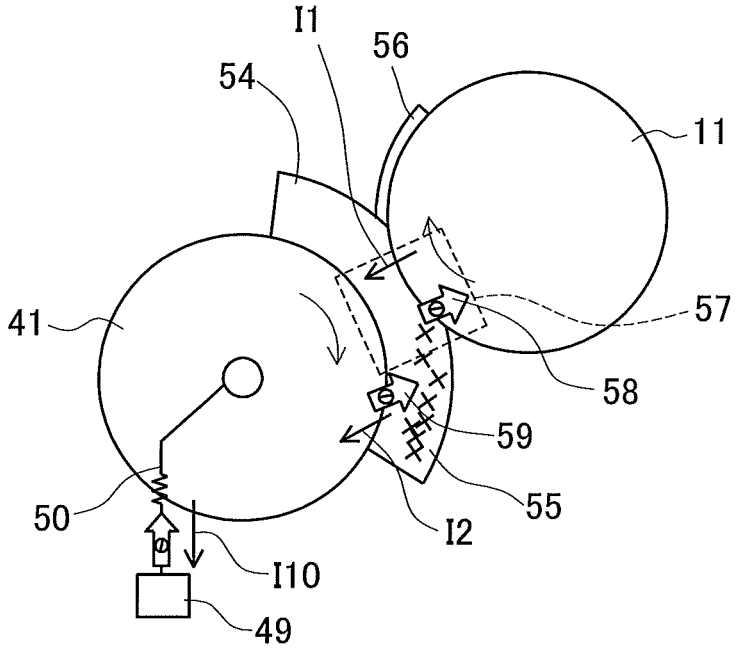
FIG. 4 is a diagram for explaining the developing current flow when the resistor is used (in a high mode)

FIG. 3 shows that movement 58 of the toner from a pre-development developer layer 54 on the surface of the developing roller 41 (the developing operation) forms a toner layer 56 on the surface of the photoconductor 11. The pre-development developer layer 54 loses a portion of the toner by developing and becomes an after-development developer layer 55. This region where the movement 58 of the toner occurs is defined as a developing region 57. In the developing region 57 in FIG. 3, negative electric charge moves with the movement 58 of the toner, and thus developing current I1 flows.

The after-development developer layer 55 which has lost a portion of the toner by developing is in a state that carrier is contained excessively to the toner. The carrier is positively charged as opposed to the toner, and hence the after-development developer layer 55 which has just come out of the developing region 57 is positively charged. The amount of that positive electric charge is equal to a total amount of the negative electric charge of the toner that has moved at the time of developing. However, the negative electric charge is replenished by the developing roller 41 (as indicated with an arrow 59), and thus the positive charge of the after-development developer layer 55 is discharged. This replenishment 59 of the negative electric charge by the developing roller 41 to the after-development developer layer 55 leads to flow of discharge current I2. Total current I10 (=I1+I2) as a sum of the developing current I1 and the discharge current I2 will flow between the developing roller 41 and the developing bias power source 49.

In the low mode in FIG. 3, the developing roller 41 and the developing bias power source 49 short with each other, and therefore the total current I10 does not have specific limitation to flow. Accordingly, discharge of the after-development developer layer 55 continues until the positive charge is completely removed. Thus, the amount of the discharge current I2 becomes equal to the amount of the developing current I1. Further, the after-development developer layer 55 reaches a non-charged state by the time when the developer layer 55 returns to the housing 45 in the developing device 14. The thus non-charged developer is returned to the housing 45 and stirred with both a developer stored in the housing 45 and toner newly replenished from the toner hopper 25, and thus the developer layer 55 turns into the pre-development developer layer 54 again.

The high mode in FIG. 4 is similar to the low mode in FIG. 3 in which the developing current I1 flows in the developing region 57 by the movement 58 of the toner. However, in the high mode, the fixed resistor 50 is interposed between the developing roller 41 and the developing bias power source 49, and therefore the total current I10 is limited by the resistance value of the fixed resistor 50. However, the limitation of the total current I10 is designed not so large to obstruct flow of the developing current I1. The developing current I1 is determined by a content of an image to be formed, and as a result of limitation of the total current I10, the discharge current I2 is limited.

To be more specific, in the high mode, the discharge current I2 is small, and hence discharge of the after-development developer layer 55 is not completely performed. As a result, the developer remaining with the positive charge returns to the housing 45. Thus, the developer in the housing 45 is slightly positively charged. Accordingly, when the pre-development developer layer 54 is to be newly formed, negative charge of the toner is restrained.

In the developing device 14 of the first embodiment, the switch 52 is operated as follows during image forming. Firstly, the switch 52 is initially connected to the bypass path 51. In other words, in a normal state, image forming is performed in the low mode in FIG. 3. When the negative charge of the toner (hereinafter, simply referred to as the toner charge) becomes excessive, the switch 52 is shifted to a side of the fixed resistor 50 so that the image forming proceeds in the high mode in FIG. 4. When the excessive toner charge is removed, the switch 52 is returned to a side of the bypass path 51.

Figure 5:
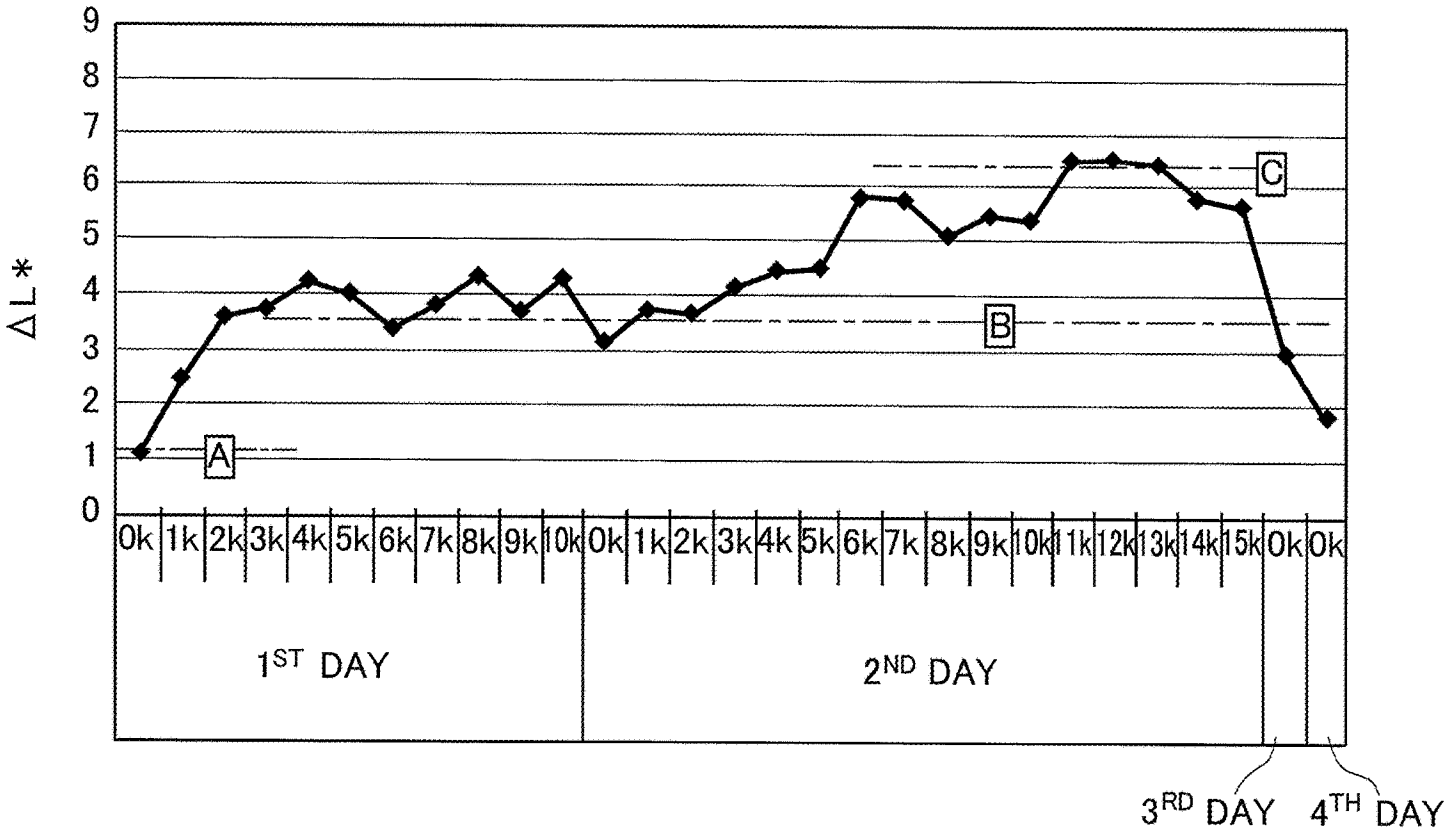
FIG. 5 is a graph showing an occurrence of density unevenness in the low mode during an endurance test.

Herein, a test is conducted to scrutinize generation of density unevenness of images formed by high-duty image forming fixedly under the low mode. Test results are shown in and explained with reference to FIG. 5. FIG. 5 is a graph showing transition of generation of density unevenness during the test. In the test, as shown in FIG. 5, endurance printing of ten thousand sheets on the first day and fifteen thousand sheets on the second day are performed, and density unevenness of the formed images are measured per each one thousand sheets on each day. The third and fourth days are set as suspension days in each of which the image forming apparatus is left for the whole day and only one sheet is printed at the end of the relevant day to measure the density unevenness of the formed image. Throughout this test, a target for printing is the same binary image with about 3% coverage (which belongs to a low coverage). The density unevenness measurement is performed in a state in which runout (eccentricity) of the photoconductors 11 are set to an upper limit in an allowable range. This setting of runout is intended to conduct the test such that density unevenness in a cycle of the rotating photoconductor is easily generated in the formed images. Further, the test is conducted under a low-temperature and low-humidity environment (LL), in which the toner is apt to be excessively charged, namely, on the condition of a temperature of 10° C. and a humidity of 15% (relative humidity, the same goes for the following). A vertical axis in the graph shown in FIG. 5 indicates a maximum difference ΔL* between brightness values L* measured on the image, the maximum difference ΔL* having been standardized with an appropriate scale.

The density unevenness before starting the endurance printing (0 k) on the first day is rarely perceived by or visible to the naked eyes, which is rated as a level A. When the endurance printing starts, the density unevenness gets worse, and after printing two thousand sheets (2 k) to three thousand sheets (3 k), the density unevenness becomes worse to be visible to the eyes, which is rated as a level B. The density unevenness remained almost unchanged in the rest of the first day. The unevenness is almost similar to the first day at the start of printing (0 k) on the second day, and no obvious improvements are seen in the level of the density unevenness from the level at the end of printing on the first day (10 k). When the endurance printing on the second day starts, the density unevenness got further worse and reached a level C which is clearly worse than the level B after printing of six thousand sheets (6 k). Almost the same level of unevenness continues in the rest of the second day. After suspension of the whole day (the third day, 0 k) from the end of the second day (15 k), the level was improved to about the level B. At the time of suspension of one more day (the fourth day, 0 k), the level is further improved to about the level A.

The following two facts are drawn from the results in FIG. 5. Firstly, it is confirmed that when image forming is repeated under the fixed low mode, the density unevenness of images tends to get worse. Consequently, generation of density unevenness is conceivably caused by the excessive toner charge from the above result. Secondly, even when the toner charge becomes excessive, the density unevenness can be improved by leaving the image forming apparatus 1 in a suspension state. To be specific, the whole day suspension results in effective improvement to a certain extent, and the unevenness level is further improved to an almost original level by the two-day suspension. This is conceivably because the excess charge of the toner is attenuated by self-discharge. However, one short-term suspension shorter than the whole day, for example, a term from the closing time of a working day to the start of the operation on the next day does not necessarily appear to be enough to achieve an effective improvement.

Next, another test is conducted to compare generation of density unevenness on the image formed by the high-duty image forming between the fixed low mode and the fixed high mode. The test results are shown in FIG. 6. The test is conducted such that, as shown in FIG. 6, ten thousand sheets are printed each day with the same binary image at about 5% coverage (which also belongs to the low coverage) under a condition of a temperature of 20° C. and a humidity of 60%, which is classified as an NN environment. The density unevenness is measured at the end of each day. According to the results shown in FIG. 6, in the low mode, the density unevenness on the first day is determined as the level B, and that on the second day is determined as the level C. This result is consistent with the test result shown in FIG. 5 and thus the test in the low mode is not conducted on the third day. In the high mode, the density unevenness on the first day is determined as the level B as in the low mode, but this level B is maintained without going down to the level C on the second and subsequent days. Accordingly, it can be admitted that the high mode can achieve an effect of restraining excess charge of the toner in the high-duty low coverage printing.

The resistance controller 26 in the first embodiment performs the following control according to the setting made based on the results shown in the above FIGS. 5 and 6. A table shown in FIG. 7 is firstly explained. The table shown in FIG. 7 indicates various threshold values to determine whether or not to switch from the low mode to the high mode according to the number of printing sheets.

In FIG. 7, the leftmost column of the table indicates "the number of days" and is divided into three levels of "the first day," "the second day," and "the third and subsequent day(s)." Specifically, this column represents the number of days from a starting day of continuous printing operation to the present day when the image forming apparatus 1 is consecutively operated for days, and namely, represents the number of consecutive operation days. When the number of consecutive operation days is increased, charge of the toner is apt to be accumulated, resulting in excess charge. Thus, for "the number of days", lower threshold values are set in a lower section of the relevant column. Operation record information of the image forming apparatus 1 for each day is recorded in the general controller 28, and hence information of "the number of days" can be obtained.

A second left column in FIG. 7 indicates "environment" and is divided into three-level conditions indicated with "LL," "NN," and "HH" in each section of the operation days respectively. These conditions represent the temperature and the humidity each obtained by the environment sensor 27. "LL" represents a low-temperature low-humidity condition, "NN" represents a medium-temperature medium-humidity condition, and "HH" represents a high-temperature high-humidity condition. Under the same operation-day condition, the higher the temperature and the humidity are, the higher threshold value is set. In general, the higher the temperature and the humidity are, the toner's excess charge is less likely to happen. It is a design choice to decide specific numerical values for L (low), N (medium), and H (high), and these values may be classified as indicated in the following Table 1, for example.

TABLE 1

| | | |
|---|---|---|
| Low temperature: 10° C. or less | Medium temperature: 10° C. to 30° C. | High temperature: 30° C. or more |
| Low humidity: 30% or less | Medium humidity: 30% to 80% | High humidity: 80% or more |

If the temperature and the humidity are classified in different levels of L (low), N (medium), and H (high) from each other, it is uniformly determined for example by prioritizing the one classified in the higher level over the other.

The second right column in FIG. 7 indicates "the number of sheets printed per day." Values indicated in this column are threshold values respectively designated for each condition of "the number of days" and "the environment." "The number of sheets printed per day" represents the number of image-formed sheets on that day. In other words, when the number of sheets reaches the threshold value, the variable resistance unit 53 is switched from the low mode to the high mode. Namely, it is a rather rough method, but the actual number of image-formed sheets is used as a charge amount signal which reflects the toner charge amount. When the high-duty image forming is performed as mentioned above, the toner charge amount tends to be increased. The number of the image-formed sheets in the image forming apparatus 1 is counted by the general controller 28.

The rightmost column of the table shown in FIG. 7 indicates "the average number of printed sheets per day." Each value indicated in this column is also a threshold value designated for each condition respectively. "The average number of printed sheets per day" represents an average number of printed sheets per day during the term from the starting day of the consecutive operation to the present date. Namely, when the average number of printed sheets reaches the threshold value by carrying out printing operation on that day, the variable resistance unit 53 is switched from the low mode to the high mode. In this column, "the first day" is not assigned with the threshold values based on the above definition. This is because the threshold values on "the first day" are equal to the values of the "number of printed sheets per day."

In the column of "the number of printed sheets per day" in FIG. 7, the threshold value under the "LL" condition on "the first day" is set as five thousand sheets. This number is larger than two thousand to three thousand as the number of sheets rated as the level B on the first day in the previous test in FIG. 5. The number is thus set because, firstly, it is not necessarily true in an actual image forming that only image forming with a low coverage of 3% is performed as in the test. Secondly, in the actual image forming, it is not necessarily true that the image forming is performed without a break as continuous printing like the test printing. Both the reasons lead to reduction of the toner excess charge.

Determination of switching the mode is made by logical disjunction of the threshold values in the both columns of "the number of printed sheets per day" and "the average number of printed sheets per day." Specifically, assuming that in the LL environment, the image forming on the first day came to an end just before the number of sheets reaches five thousand. In this case, the variable resistance unit 53 remains set in the low mode. However, when the image forming on the second day reaches four thousand, switching to the high mode is performed. Alternatively, when the average number of image-formed sheets on the first day and the second day reaches four thousand and five hundred, the switching is performed also.

Figure 8:
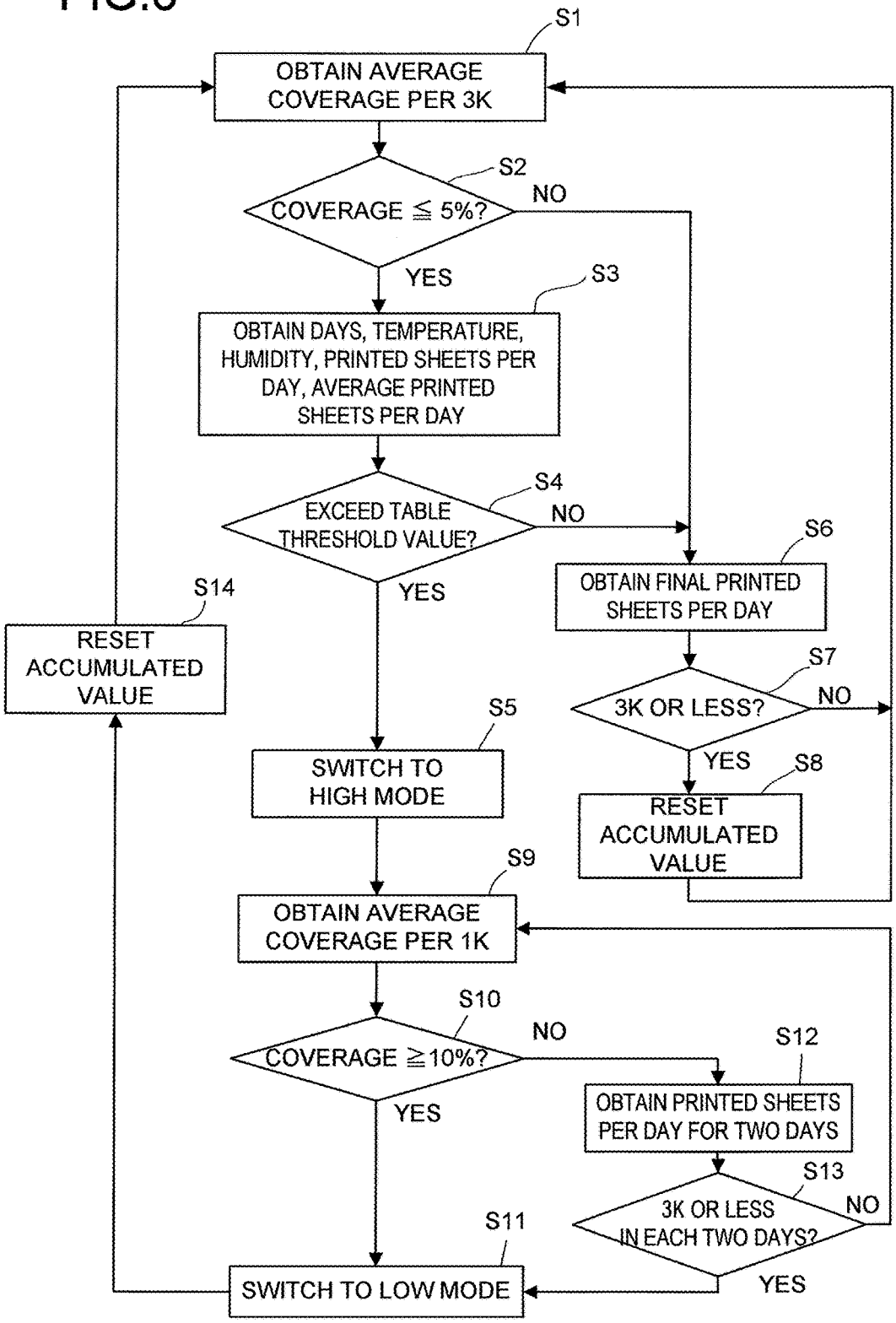
FIG. 8 is a flow chart for a mode switching control in the first embodiment.

The mode control based on the table shown in FIG. 7 as mentioned above is actually performed as indicated with a flow chart in FIG. 8 in consideration of a coverage of an image to be formed. The first half part (S1 to S8) of this flow is basically intended to determine whether or not the toner is excessively charged and to switch from the low mode to the high mode when the toner is excessively charged.

Every time after image forming operations of three thousand sheets, the resistance controller 26 obtains an average coverage of the relevant latest three thousand sheets formed with images (S1). The coverage information of the past image forming necessary for obtention of the average coverage has been stored in the general controller 28. This obtention of the average coverage in S1 is a trigger for determining whether or not to switch from the low mode to the high mode.

Subsequently, it is determined whether or not the obtained average coverage is 5% or less (S2). This value of 5% is a predetermined threshold value for determining that the coverage of an actually formed image is low or high. When a large number of image forming is made with low coverage, the toner is insufficiently replaced, leading to the toner excess charge. In short, the coverage information of the actually formed image is useful as one of the charge amount signal that reflects the toner charge amount.

When the obtained average coverage is equal to or less than 5% (S2: Yes), there is a possibility that the toner has been excessively charged. Accordingly, information of "the number of days," the temperature, the humidity, "the number of printed sheets per day," and "the average number of printed sheets per day" at the present time is obtained (S3). These values are necessary data for comparing with the table shown in FIG. 7.

Based on the data obtained in S3, it is determined whether or not the obtained values exceed the threshold values of the table in FIG. 7 (S4). To be more specific, based on the obtained information of "the number of days," the temperature, and the humidity, it is determined to use the threshold values in which line in the table of FIG. 7. The obtained information of "the number of printed sheets per day" and "the average number of printed sheets per day" is then compared with the threshold values in the determined line. When any one of "the number of printed sheets per day" and "the average number of printed sheets per day" exceeds the corresponding threshold value, it is determined that the obtained value exceeds the table threshold value.

When it is determined the value exceeds (S4: Yes), the variable resistance unit 53 is switched to the high mode shown in FIG. 4 (S5). This is because it is considered that the high-duty image forming with low-coverage has been continuing and the toner charge has become excessive. In other words, image forming has been continuing under the situation that the average coverage is lower than the predetermined value and "the number of printed sheets per day" or "the average number of printed sheets per day" could exceed each threshold value which is predetermined in accordance with environmental factors, in this situation. This situation is a charge-increase (charge-up) situation of the first embodiment. As a result, the subsequent image forming is carried out in the high mode, and thus the toner charge is restrained.

Referring back to S2, when the obtained average coverage exceeds 5% (S2: No), switching to the high mode is not performed this time. This is because it is considered that image forming has been performed with relatively high coverage images and thus the toner has been replaced enough. Further, even when both "the number of printed sheets per day" and "the average number of printed sheets per day" do not exceed the corresponding threshold values (S4: No), switching to the high mode is not performed also this time. This is because it is concluded that image forming has not been performed under the high-duty situation.

In those cases, a final value of "the number of printed sheets per day" is obtained (S6). Then, it is determined whether or not the obtained "number of printed sheets per day" is three thousand sheets or less (S7). When the number of sheets is equal to or less than three thousand (S7: Yes), an accumulated value is reset (S8), and the flow goes back to S1. The accumulated value is reset because it is considered that image forming has been performed under not-high-duty situation for a certain term. Accordingly, it is anticipated that switching to the high mode is unnecessary for a while. When the number exceeds three thousand in S7 (S7: No), the flow goes back to S1 without resetting the accumulated value. This is because the image forming has been performed under a situation that is not so low-duty as to ensure non-necessity of switching to the high mode for a while.

Subsequently, a flow of the control to be executed after the switching to the high mode is done in S5 is explained in a second half part (S9 to S14) in FIG. 8. After the switching to the high mode, on the contrary, the flow is intended to determine whether or not the toner's excess charge is removed and to return to the low mode from the high mode if it is determined that the excess charge is removed.

The resistance controller 26 is therefore operated to obtain an average coverage of every one thousand sheets in image forming of the one thousand sheets which has just been printed (S9). This obtention of the average coverage in S9 is a trigger to determine whether or not to switch from the high mode to the low mode. As compared with S1, the determination of recovering to the low mode is performed more frequently than the determination of shifting to the high mode. This is because it is not preferable to perform image forming in the high mode more than necessary. As explained above with reference to FIG. 4, in the high mode, the toner charge is restrained. The high mode is useful for removing the excess charge of the toner, but on the other hand, if the toner is used too much in the high mode, shortage in toner charge is caused, resulting in insufficient development. Accordingly, soon after the excess charge of the toner is removed, the variable resistance unit 53 should be switched back to the low mode.

Subsequently, it is determined whether or not the obtained average coverage is 10% or less (S10). This value of 10% is, as similar to 5% used in the above mentioned S2, a threshold value to determine the actually formed image is low coverage or high coverage. However, the value is set higher than the value in S2. This is because the switching back to the low mode should be done only when the excess charge of the toner is surely removed. Further, it is also intended to prevent the toner charge becomes excess again shortly after returning to the low mode.

When the obtained average coverage is 10% or more (S10: Yes), the operation mode is switched to the low mode shown in FIG. 3 (S11). Image forming with relatively high-coverage images has been performed, and therefore it is conceived that the excess charge of the toner is removed.

When the obtained average coverage is less than 10% on the other hand (S10: No), information of "the number of printed sheets per day" of the latest two days is obtained (S12). Even when it is not determined from the coverage of image forming that the excess charge of the toner is removed, there is a case that removal of the excess charge can be determined by other information. One of such an information source is whether or not the latest operation condition of the image forming apparatus 1 is high duty.

Therefore, it is determined whether or not the obtained values of "the number of printed sheets per day" of both the latest two days are three thousand sheets or less (S13). When both the values are equal to or less than three thousand or less (S13: Yes), as similar to S10 as Yes, the switching to the low mode is done (S11). Because the low-duty operation has continued for two days, it is conceivable that the excess charge of the toner is removed by the self-discharge.

Specifically, there are two kinds of charge-down situation in the first embodiment. One is that image forming of relatively high average coverage continues for a certain term. As for the threshold values for determining the average coverage as being high or low, the threshold values are differentiated in a case of switching from the low mode to the high mode and in a case of switching from the high mode to the low mode. Thereby, determination of switching is made carefully. The other situation is that non-high-duty image forming operation has continued for a predetermined period of time.

When any one of the obtained values of "the number of printed sheets per day" of the two days exceeds three thousand (S13: No), the switching to the low mode is not made this time. It is considered that high-coverage image forming has not been made for a while and that the operation condition of low duty has not continued long enough, and therefore it cannot be determined that the excess charge of the toner is removed. Accordingly, the flow goes back to S9.

When the switching to the low mode is done in S11, the accumulated values are reset (S14) and the flow goes back to S1. The accumulated values are reset because it is assumed that there is no need to switch to the high mode again for a while. The switching back to the low mode has performed based on the determination that the excess charge of the toner is surely removed. As above, explanation for the flow chart shown in FIG. 8 is ended.

In the first embodiment explained above, each threshold value may be appropriately changed in accordance with processing condition and material condition of the image forming apparatus 1. Further, the controlling operation is made based on "the number of days" in the present embodiment, but it is also applicable to more precisely control based on a unit of "an hour" or "a minute." Furthermore, the controlling operation may be performed more finely by recording the operation time and the suspension time of the image forming apparatus 1 separately and providing threshold values for each time. As another alternative, while the variable resistance unit 53 is in the high mode as mentioned above, the alternating-current component of the developing bias in the developing bias power source 49 may be off. Alternatively, amplitude of the alternating-current component may be less than in the normal state. Reducing or deleting the alternating-current component in the developing bias maintains the positive charge of the carrier, which is useful for restraining the negative charge of the toner.

Second Embodiment

Figure 9:
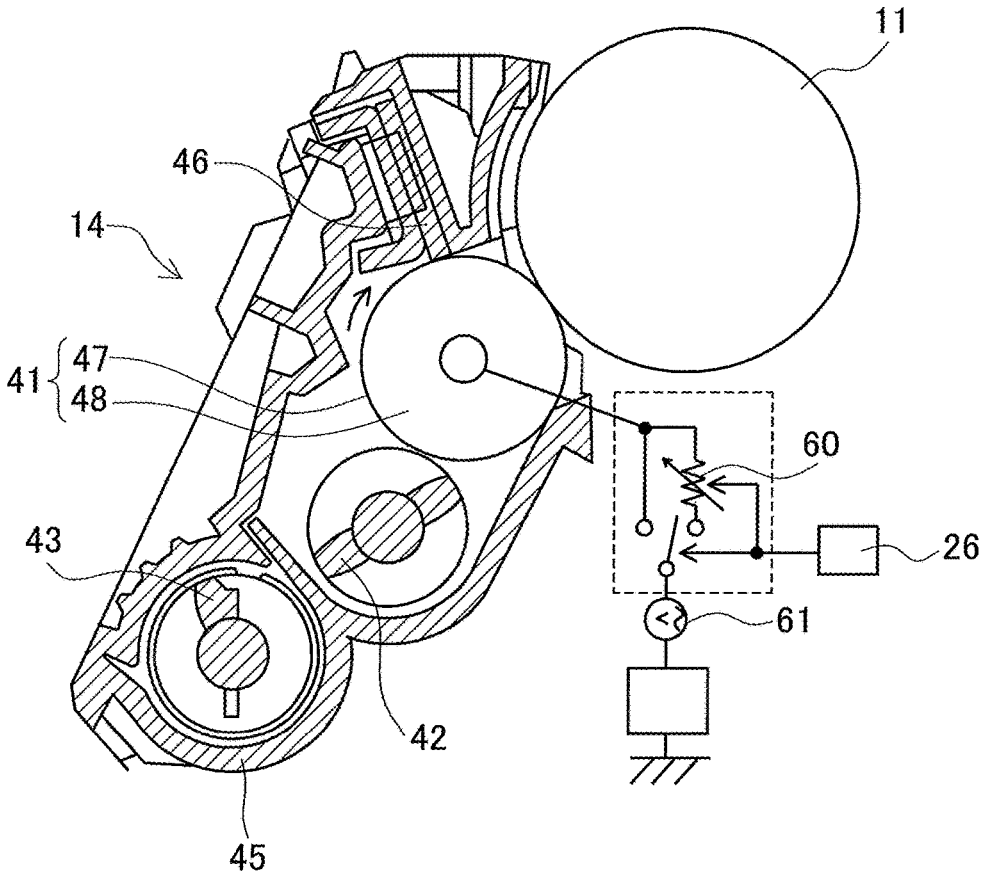
FIG. 9 is a configurational sectional view of a developing device in a second embodiment.

A developing device 14 in a second embodiment is now explained. The developing device 14 in the second embodiment has a configuration as shown in FIG. 9. The developing device 14 shown in FIG. 9 has two features different from the device of the first embodiment shown in FIG. 2 as explained below.

(a) A variable resistor 60 is provided instead of the fixed resistor 50.

Therefore, the variable resistor 60 is one of objects to be operated by the resistance controller 26.

(b) An ammeter 61 is provided on a current flow path between the developing roller 41 and the developing bias power source 49.

The variable resistor 60 is reasonably a resistor in which its resistance value is variable. The maximum resistance value is, as similar to the fixed resistor 50, preferably 10 to 150 (MΩ). When the minimum resistance value of the variable resistor 60 is in a range of 0 (Ω) to 50 (Ω), the bypass path 51 and the switch 52 may be omitted and the variable resistance unit 53 may be configured only with the variable resistor 60.

The second embodiment is configured as basically similar to the first embodiment such that the resistance of the variable resistance unit 53 is set to be 0Ω or the minimum value in the normal state (in a low mode). When the toner charge gets excessive, the resistance of the variable resistance unit 53 is increased (in a high mode) so that the charge of the toner is to be reduced to a normal state. In the high mode of the second embodiment, furthermore, the resistance value of the variable resistance unit 53 is adjusted to the most favorable value by utilizing an indicated value of the ammeter 61 and a density value measured by the image density sensor 29.

Therefore, in the second embodiment, the charge amount of the toner, more precisely, the charged amount per mass of the toner is measured and based on the measured result, a designated resistance value of the variable resistance unit 53 at the present time is determined. This determination process is conducted periodically and in association with carrying out image stabilization control which is performed regularly in the image forming apparatus 1. Frequency of performing the image stabilization control is mostly about every five hundred sheets. After the designated resistance value is determined, image forming is performed with the designated resistance value until the next determination process is carried out.

Firstly, a process of determining the designated resistance value of the variable resistance unit 53 is explained. The process is indicated as below.

(i) The resistance value of the variable resistance unit 53 is varied and the total current I10 in developing during image forming of a solid image is measured at each resistance value.

(ii) The developing current I1 of the total current I10 is obtained by the measured result obtained in the above (i).

(iii) The charge amount of the toner is calculated based on the obtained developing current I1.

(iv) The designated resistance value of the variable resistance unit 53 is determined based on the calculated charge amount.

Figure 10:
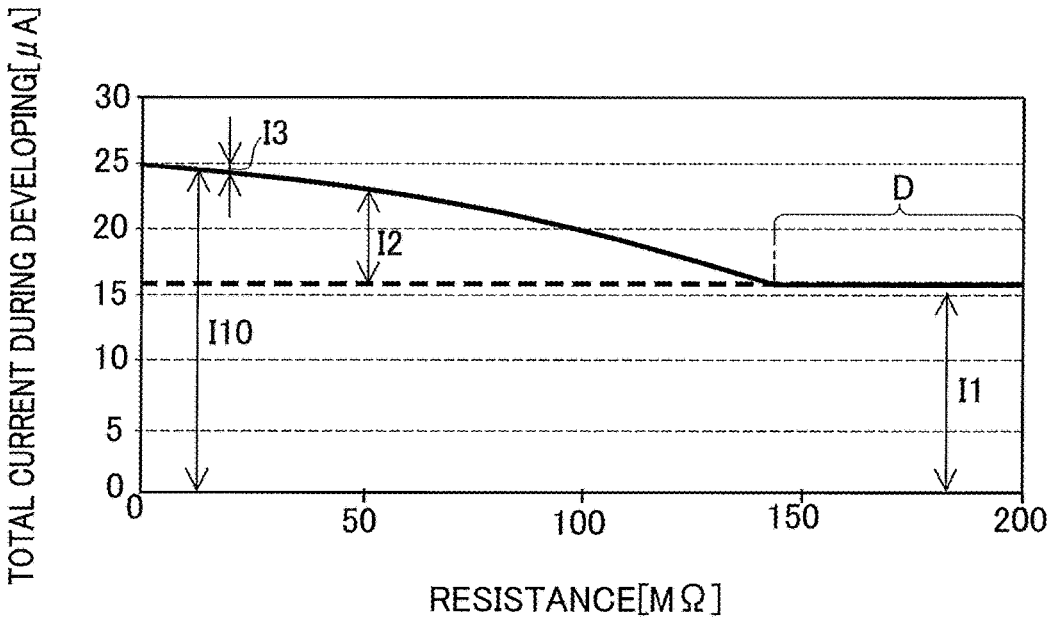
FIG. 10 is a graph showing a relationship between a resistance value and a total current resistance value for developing.

Measurement process of the total current I10 in (i) is now explained. It is objected to learn a relationship of the resistance value of the variable resistance unit 53 and the total current I10. Therefore, while varying the resistance value of the variable resistance unit 53, a solid image with a predetermined image density is formed at each resistance value. During each image forming, the value indicated in the ammeter 61 is obtained. The thus obtained current value represents the total current I10 at each resistance value. Thus, a graph of FIG. 10 is obtained. A bold solid curved line in FIG. 10 indicates the total current I10 (a vertical axis) at each resistance value (a lateral axis).

However, if the resistance value of the variable resistance unit 53 is varied simply, density of the formed solid image is affected. Therefore, at each resistance value, it is necessary to vary the developing bias in order to find a developing bias value by which the targeted image density with the corresponding resistance value can be obtained. Whether or not the targeted image density is obtained is recognized from the measured value of the image density sensor 29. A graph (a current table) in FIG. 10 indicates the total current I10 obtained when a solid image with a predetermined image density is formed at each resistance value while the developing bias value is varied in association with varying the resistance value.

Obtention of the developing current I1 in (ii) is explained. According to the graph of FIG. 10 obtained in (i), the value of the total current I10 becomes the largest when the resistance value is the smallest. As explained above with FIG. 3, the total current I10 is the sum of the developing current I1 and the discharge current I2. When the resistance value is increased, the total current I10 decreases. This is because the discharge current I2 is restricted as mentioned above in FIG. 4. However, when the resistance value is increased to some extent and more, decline in the total current I10 stops and the total current I10 is fixed despite of the resistance value (see a region D in FIG. 10). In this region D, it is considered that the carrier in the after-development developer layer 55 is not discharged and the total current I10 itself represents the developing current I1. In other words, the value of the total current I10 in the region D is the smallest among the values of the total current I10 shown in FIG. 10, and the value represents the developing current I1. Accordingly, the developing current I1 can be read out from the graph in FIG. 10. This is the method of obtaining the developing current I1.

Subsequently, calculation of the toner charge amount in (iii) is explained. The developing current I1 obtained in (ii) is multiplied by a developing time T required for one sheet of a solid image to pass through the developing region 57, and thus a total electric charge amount Q (=I1×T) of the toner required for developing one sheet with a solid image is obtained. Since the density of the solid image is predetermined as mentioned above, mass G of the toner for one sheet of the solid image is known. Then, the total electric charge amount Q is divided by the mass G to obtain an electric charge amount q (=Q/G) per mass of the toner. This amount is defined as the toner charge amount q. In this manner, the toner charge amount is calculated. Namely, the electric charge amount corresponding to the developing current I1 is divided by the toner's mass corresponding to the density of the solid image so as to obtain the toner charge amount q.

In the above explanation, the developing bias is varied in accordance with varying the resistance value of the variable resistance unit 53 to make the density of the solid image constant. Alternatively, it is also possible to measure the toner charge amount in such a way that the developing bias is fixed but only the resistance value of the variable resistance unit 53 is varied. In this case of fixing the developing bias, when a graph similar to FIG. 10 is made, further steeper curve which is steadily declining as a whole is drawn, and the graph continues to decline in a portion corresponding to the region D. Therefore, it is impossible to read out the developing current I1 from a horizontal portion of the graph.

However, from the above explanation, it is still true that the total current I10 itself represents the developing current I1 even if the developing bias is fixed in a region close to the right end of the lateral axis in the graph of FIG. 10. Further, the density of the formed solid image with the relevant resistance value can be measured by the image density sensor 29. Accordingly, the image density can be selected and used from each of the measured image density values. Thus, with the arbitrary resistance value in the region near the right end of the lateral axis in FIG. 10, the total current I10 and the density of the solid image can be measured while the developing bias remains at a standard value. The toner charge amount can be calculated as similar to the above mentioned calculation. To be sure, the toner charge amount is calculated by this method with the resistance value at several levels in the region close to the right end of the lateral axis in FIG. 10, and the smallest value among them may be adopted.

Next, how to determine the designated resistance value of the variable resistance unit 53 in (iv) is explained. Information necessary for this determination is the following five factors.

(1) The toner charge amount q calculated as above.

(2) An upper limit qu within a preferable range of the charge amount q.

(3) The graph of FIG. 10.

(4) The toner application amount with a standard image density at the time when the graph of FIG. 10 is made.

(5) A developing area per one second of image forming.

The upper limit qu has been predetermined. When the calculated charge amount q is equal to or less than the upper limit qu, determination of the upper limit is unnecessary. In that case, it is enough to remain the resistance value of the variable resistance unit 53 as the smallest. When the charge amount q exceeds the upper limit qu, the designated value is determined as follows.

An excess charge amount (q−qu) is calculated first. When the calculated charge amount q is 60 (μC/g) and the upper limit qu is 50 (μC/g), the excess charge amount (q−qu) is 10 (μC/g).

This excess charge amount (q−qu) is multiplied by a reference toner application amount in the above (4) and the developing area per second in the above (5) to calculate an excess amount of the developing current I1. The reference toner application amount may be determined in advance. The developing area per second is a product of a moving amount per second of a surface of the photoconductor 11 which rotates in image forming and a widthwise dimension of an image. This developing area per second is a known value designed according to the configuration of the image forming apparatus 1. Supposing that the reference toner application amount is 4.5 ($g/m^2$), when the calculation is made under the process condition of the image forming apparatus 1 in the present embodiment, the excess developing current I1 with the above excess charge amount (q−qu) is calculated as 2.5 (μA).

The resistance value is obtained from the graph in FIG. 10 such that the excess developing current I1 is offset (subtracted) by the resistance value. To be specific, in the graph of FIG. 10, a difference I3 between the total current I10 with the resistance value 0 (MΩ) and the total current I10 with each resistance value is obtained. The resistance value may be chosen such that the difference I3 is almost equal to the excess amount. In FIG. 10, the difference I3 is about 2.5 (μA) when the resistance value is about 25 (MΩ). Therefore, when the excess charge amount (q−qu) is the above value, the designated resistance value of the variable resistance unit 53 may be determined as 25 (MΩ). As mentioned above, the designated resistance value of the variable resistance unit 53 is determined.

Figure 11:
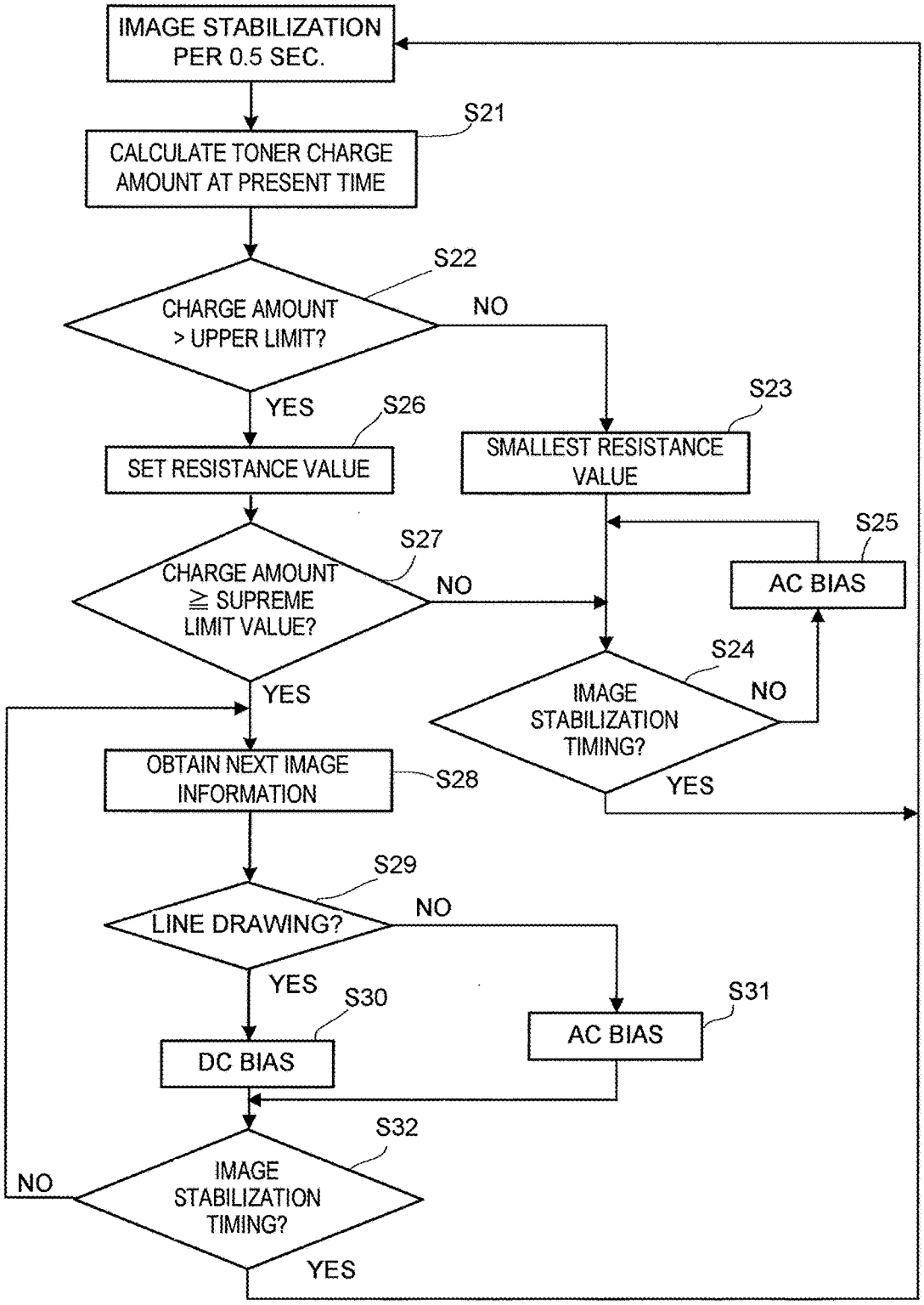
FIG. 11 is a flow chart for the resistance value and a bias control in the second embodiment.

A specific controlling process in the second embodiment is explained with reference to a flow chart in FIG. 11. As mentioned above, in the second embodiment, the resistance value is designated at the time when the image stabilization control is periodically (herein, once in five hundred sheets of image forming) performed. When determining the designated resistance value, firstly, the present toner charge amount (the charge amount q) is calculated (S21). This calculation is carried out in the processes of (i) to (iii) among the processes of (i) to (iv) mentioned above.

Subsequently, the calculated charge amount q is compared with the upper limit qu, and it is determined whether or not the charge amount q exceeds the upper limit qu (S22). When the charge amount q is equal to or less than the upper limit qu (S22: No), the resistance value of the variable resistance unit 53 is determined to be "the lowest" (S23), which means the low mode. Then, it is determined whether or not the next timing of image forming stabilization control has come (S24). When the timing has not come yet (S24: No), image forming is carried out in response to job requests. At that time, as the developing bias, the bias in which the alternating-current component is superimposed with the direct-current component is used as usual (S25). Until the next timing of image stabilization control, image forming continues in the low mode. When the timing of next image stabilization control has come (S24: Yes), calculation of the charge amount q is performed again (S21).

When the charge amount q exceeds the upper limit qu in S22 (S22: Yes), the resistance value of the variable resistance unit 53 needs to be set higher than "the lowest" value. This is because the toner charge amount is excessive. Accordingly, the resistance value set for the variable resistance unit 53 is designated (S26). This designation is based on the above mentioned (iv). After designating the resistance value, the resistance value of the variable resistance unit 53 is set as the designated value. Namely, the variable resistance unit 53 is shifted to the high mode. In the second embodiment, the fact that the measured charge amount q exceeds the predetermined upper limit qu is the charge-up situation.

Further subsequently, it is determined whether or not the charge amount q is equal to or more than the charge amount which is predetermined as a supreme limit value (S27). The supreme limit value means the value at which the alternating-current superimposed bias as usual can be used as the developing bias. This supreme limit value has been determined in advance as the value higher than the above mentioned upper limit qu. When the upper limit qu is determined to be 50 (μC/g) as above, for example, the supreme limit value may be determined about 60 (μC/g).

When the charge amount q is less than the limit value (S27: No), similarly to the low mode as mentioned above, the flow goes to S24. Specifically, while the variable resistance unit 53 is in the high mode, the alternating-current superimposed bias as usual is used as the developing bias and image forming continues until the next timing of image stabilization control has come (S25). If the charge amount q is measured to be low in the next image stabilization control, the variable resistance unit 53 is returned to the low mode in the flow of S22: No and S23. In the second embodiment, the fact that the measured charge amount q decreases to or less than the upper limit qu is the charge-down situation.

When the charge amount q is equal to or more than the limit value in S27 (S27: Yes), information of an image to be subsequently formed is obtained from the general controller 28 (S28). Then, it is determined whether or not the image is classified as a so-called line drawing (S29). The line drawing is an image that does not have a certain amount of solid area. For example, a text document and an image configured with a line figure correspond to the line drawing. On the contrary, images including a photograph or a solid region are not classified as the line drawing.

When the image about to be formed is the line drawing (S29: Yes), that image is formed by the direct-current developing bias in which the alternating-current component is off (S30). As an alternative, the developing bias in which an amplitude of the alternating-current component is made smaller than the usual time may be used. As mentioned above, the developing bias with the restrained alternating-current component is advantageous for restraining the toner's negative charge. At the present state, the toner's excess charge is further noticeable, and thus such a bias is recommended to be used. Further, in the line drawing which has no solid region, even if image forming is performed with restraining the alternating-current component in the developing bias, problems due to the thus bias rarely occurs. In general, the line drawing has low coverage, and the toner's excess charge tends to be further facilitated.

On the other hand, when the image about to be formed is not the line drawing (S29: No), that image is formed by the normal alternating-current superimposed bias (S31). It is preferable to use the direct-current bias in view of the toner charge state, but there is a possibility of causing density unevenness in a solid region by using the direct-current bias. Further, the image including the solid region has a high coverage to some extent, and thereby the toner's excess charge is likely to be reduced.

After image forming in S30 or S31, it is determined whether or not the next image stabilization control timing has come (S32). When the timing has not come yet (S32: No), the flow goes back to S28 and the same process is carried out for the next image. Specifically, when the measured charge amount q reaches the high limit value higher than the upper limit, the alternating-current superimposed bias or the direct-current bias (or the bias restrained with the alternating-current bias) is selected according to contents of the image and the image forming is carried out in the high mode until the timing of the next image stabilization control comes.

When the timing of the next image stabilization control has come (S32: Yes), the charge amount q is calculated again (S21).

In the second embodiment, the low mode or the high mode is selected in every image stabilization timing, and the resistance value of the variable resistance unit 53 is designated in a case of the high mode. Further, when the charge amount q is exceptionally high, the high mode is adopted and the developing bias is controlled in an exceptional way. In this manner, image forming is performed with appropriate controlling operations in accordance with increase and decrease in the toner charge amount. Thus, the toner's excess charge is restrained and favorable image forming with less density unevenness can be realized.

As explained in detail above, according to the present embodiment, the image forming apparatus 1 using the two-component developer is provided with the variable resistance unit 53 placed between the developing roller 41 and the developing bias power source 49, and therefore the two control modes of the low mode and the high mode are provided. Thus, there are realized the developing device 14 and the image forming apparatus 1 which enable to prevent the toner charge in the normal operation and restrain the toner's further charge when the toner is prone to be excessively charged, and further perform preferable image forming without consumption of toner by test printing.

Furthermore, the variable resistance unit 53 is configured with the variable resistor 60, and the ammeter 61 and others are provided to measure the toner's charge amount. Thereby, it becomes possible to perform the resistance control appropriately corresponding to the actually charged state of the toner. Further, not only the resistance value of the variable resistance unit 53 but also the alternating-current component in the developing bias can be appropriately controlled.

The above embodiments only exemplify the present invention and do not give any limitation to the present invention. Accordingly, the present invention may be naturally applied with various changes and modifications without departing from the scope of its subject matter. The overall configuration of the image forming apparatus 1 may not be the one shown in FIG. 1. Specifically, the apparatus may be not only a tandem color printer but also a multi-cycle color printer or a monochrome printer. As another alternative, an apparatus may be a copying machine mounted with a scanner or an apparatus having a function of conducting transmission and reception of printing jobs through public lines.

A developing device embodied as one aspect of the present invention may be configured such that the variable resistance unit includes: a fixed resistor; a bypass path bypassing the fixed resistor; and a switch to selectively make operative any one of the fixed resistor and the bypass path, and the resistance control unit is configured to control the switch to: make operative the bypass path in the low mode; and make operative the fixed resistor in the high mode. In this configuration, when the bypass path is made operative, the variable resistance unit has low resistance to function as the low mode. On the other hand, when the fixed resistor is made operative, the variable resistance unit has high resistance to function as the high mode.

Alternatively, the device may be configured such that the variable resistance unit includes a variable resistor, and the resistance control unit is configured to: control the resistance value of the variable resistance unit to be a smallest value in the low mode; and control the resistance value of the variable resistance unit to be an enhanced value which is larger than the smallest value and to be larger when a toner's charge amount represented by the charge amount signal is higher in the high mode. Thus, in the high mode, the resistance value of the variable resistance unit may be set as appropriate in accordance with the toner charge amount. As a result, the image forming apparatus can perform further appropriate control in response to changes in the toner charge state.

In the above developing device, preferably, the resistance control unit is configured to: apply the low mode in a normal operation; switch to the high mode when a predetermined charge-up situation occurs, the charge-up situation indicating that the toner's charge amount is increased; and return to the low mode when a predetermined charge-down situation occurs, the charge-down situation indicating that the toner charge amount is decreased after the switching from the low mode to the high mode is done. To be more specific, the low mode, in which image forming failure due to shortage in the toner charge is less likely to happen, is set as a regular mode, and the high mode is applied only when it is considered that the toner charge amount becomes excessive.

In the aspect of using the variable resistor in the variable resistance unit, further alternatively, the developing device may comprise an ammeter to measure a value of current flowing in the variable resistance unit, and may be configured such that the resistance control unit is configured to: obtain a current table representing a relationship between the resistance value of the variable resistance unit and a total amount of current flowing in the variable resistance unit during developing by varying the resistance value of the variable resistance unit to a plurality of levels and performing an image forming operation with a fixed image density at each of the levels; read out a developing current which is the smallest value among total current values in the current table, the developing current flowing in association with movement of the toner from the developing roller to the image carrier during developing; obtain the charge amount signal based on an electric charge corresponding to the developing current and a toner amount corresponding to an image density of a formed image; obtain excess current as a current amount corresponding to an excess amount of the toner's charge amount represented by the obtained charge amount signal with respect to a predetermined upper limit charge amount of the toner; read out a resistance value of the variable resistance unit from the current table so that the total current is a value calculated by subtracting the excess current value from a current value obtained for the smallest resistance value of the variable resistance unit, and adjust subsequent resistance values of the variable resistance unit to the read-out value so that the high mode is set.

In the aspect of using the variable resistor in the variable resistance unit, further alternatively, the developing device may comprise an ammeter to measure a value of current flowing in the variable resistance unit and an image density sensor to measure an image density of an image developed and formed by the developing roller, and may be configured such that the resistance control unit is configured to: vary the resistance value of the variable resistance unit to a plurality of levels so that an image forming operation and measurement of an image density are performed at each of the levels to obtain a current table representing a relationship between the resistance value of the variable resistance unit and a total amount of current flowing in the variable resistance unit during developing; read out a developing current which is the smallest value among total current values in the current table, the developing current flowing in association with movement of the toner from the developing roller to the image carrier during developing and designate an image density of the image formed when the current value of the developing current is obtained as a selected image density; obtain the charge amount signal from an electric charge corresponding to the developing current and a toner amount corresponding to the selected image density; calculate excess current as a current amount corresponding to an excess amount of a toner's charge amount represented by the obtained charge amount signal with respect to a predetermined upper limit charge amount of the toner; read out a resistance value of the variable resistance unit from the current table so that the total current is a value calculated by subtracting the excess current value from a current value obtained for the smallest resistance value of the variable resistance unit; and adjust subsequent resistance value of the variable resistance unit to the read-out value so that the high mode is set.

When the variable resistance unit is configured with the variable resistor, the developing device further includes the ammeter, or both the ammeter and the image density sensor, enabling to measure the toner charge amount at the present point as mentioned above. Therefore, switching from the low mode to the high mode and determination of the resistance value of the variable resistance unit in the high mode may be further appropriately performed.

Further in the above configuration, more preferably, the resistance control unit is configured to: adjust the resistance value of the variable resistance unit to be the read-out value only if the toner's charge amount represented by the obtained charge amount signal exceeds the upper limit charge amount; and set the resistance value of the variable resistance unit to be the smallest value within a variable range which is the low mode if the toner's charge amount represented by the obtained charge amount signal is equal to or less than the upper limited charge amount.

In any one of the above mentioned developing apparatus, more preferably, the developing bias power source is configured to: apply a developing bias in which an alternating-current component is superimposed with a direct-count component in a normal operation; and apply a developing bias in which the alternating-current component is reduced or removed from the normal operation if the resistance control unit is under the high mode. In general, superimposing of the alternating-current component has an effect of preventing density unevenness within a solid region of an image. However, when the toner is likely to be excessively charged, the alternating-current component is reduced or removed so that the toner's excess charge is diminished.

Especially in the configuration that a toner charge amount signal is obtained based on the measured value of the ammeter and others, more preferably, the developing bias power source is configured to: apply a developing bias in which an alternating-current component is superimposed with a direct-current component in a normal operation; and apply a developing bias in which the alternating-current component is reduced or removed from the normal operation if the resistance control unit is under the high mode and the toner's charge amount represented by the obtained charge amount signal is equal to or more than a predetermined supreme limit charge amount which is further higher than the upper limit charge amount. Reduction or removal of the alternating-current component may only have to be performed when the toner's excess charge is exceptionally large.

Further, more preferably, the developing bias power source is the developing bias power source is configured to apply the developing bias in which the alternating-current component is removed or reduced from the normal operation only if an image to be formed is a line drawing. The line drawing has less solid region in the image and has less problems of density unevenness with less consumption of toner in accordance with image forming, and therefore reduction or removal of the alternating-current component is highly effective. On the contrary, when an image other than the line drawing is formed, the image has the solid region and the density unevenness could be problematic and the toner consumption in accordance with the image forming is large, so that reduction or removal of the alternating-current component is not so effective.

In any one of the developing device mentioned above, it is preferable that the maximum resistance value of the variable resistance unit is within a range of 10 to 150 (MΩ). The maximum resistance value of the variable resistance within the above range is usually enough for the above controlling operation. Depending on the overall configuration of the image forming apparatus, there is a case that the appropriate controlling operation may be performed with the variable resistance unit outside the above range.

Another aspect of the present invention is an image forming apparatus comprising: a photoconductor; an exposing unit to form a latent image on a surface layer of the photoconductor; and a developing device to develop the latent image formed on the photoconductor by use of toner, wherein the developing apparatus is the one described above.

REFERENCE SIGNS LIST

1 Image forming apparatus
11 Photoconductor
13 Exposing unit
14 Developing device
26 Resistance controller (resistance control unit)
27 Environment sensor
29 Image density sensor

41 Developing roller
49 Developing bias power source
50 Fixed resistor
51 Bypass path
52 Switch
53 Variable resistance unit
60 Variable resistor
61 Ammeter

What is claimed is:

1. A developing device comprising: a developing roller configured to carry a two-component developer on its surface to develop an electrostatic latent image on an image carrier; and a developing bias power source to apply a developing bias to the developing roller, wherein the developing device further includes:

a variable resistance unit provided on a bias applying path through which the bias is applied to the developing roller from the developing bias power source, the variable resistance unit being configured to selectively obtain a resistance value at two or more levels; and a resistance control unit to control the resistance value of the variable resistance unit based on a charge amount signal indicating a toner's charge amount in the two-component developer which is carried on the developing roller, the resistance control unit controls the resistance value in one of two control modes including:

a low mode to reduce the resistance value of the variable resistance unit; and a high mode to enhance the resistance value of the variable resistance unit, the low mode is selected if the toner's charge amount represented by the charge amount signal is low, and the high mode is selected if the toner's charge amount represented by the charge amount signal is high.

2. The developing device according to claim 1, wherein the variable resistance unit includes:

a fixed resistor;

a bypass path bypassing the fixed resistor; and a switch to selectively make operative any one of the fixed resistor and the bypass path, and the resistance control unit is configured to control the switch to:

make operative the bypass path in the low mode; and make operative the fixed resistor in the high mode.

3. The developing device according to claim 1, wherein the variable resistance unit includes a variable resistor, and the resistance control unit is configured to:

control the resistance value of the variable resistance unit to be a smallest value in the low mode; and control the resistance value of the variable resistance unit to be an enhanced value which is larger than the smallest value and to be larger when a toner's charge amount represented by the charge amount signal is higher in the high mode.

4. The developing device according to claim 3 comprising an ammeter to measure a value of current flowing in the variable resistance unit, wherein the resistance control unit is configured to:

obtain a current table representing a relationship between the resistance value of the variable resistance unit and a total amount of current flowing in the variable resistance unit during developing by varying the resistance value of the variable resistance unit to a plurality of levels and performing an image forming operation with a fixed image density at each of the levels;

read out a developing current which is the smallest value among total current values in the current table, the developing current flowing in association with movement of the toner from the developing roller to the image carrier during developing;

obtain the charge amount signal based on an electric charge corresponding to the developing current and a toner amount corresponding to an image density of a formed image;

obtain excess current as a current amount corresponding to an excess amount of the toner's charge amount represented by the obtained charge amount signal with respect to a predetermined upper limit charge amount of the toner;

read out a resistance value of the variable resistance unit from the current table so that the total current is a value calculated by subtracting the excess current value from a current value obtained for the smallest resistance value of the variable resistance unit, and adjust subsequent resistance values of the variable resistance unit to the read-out value so that the high mode is set.

5. The developing device according to claim 4, wherein the resistance control unit is configured to:

adjust the resistance value of the variable resistance unit to be the read-out value only if the toner's charge amount represented by the obtained charge amount signal exceeds the upper limit charge amount; and set the resistance value of the variable resistance unit to be the smallest value within a variable range which is the low mode if the toner's charge amount represented by the obtained charge amount signal is equal to or less than the upper limited charge amount.

6. The developing device according to claim 4, wherein the developing bias power source is configured to:

apply a developing bias in which an alternating-current component is superimposed with a direct-current component in a normal operation; and apply a developing bias in which the alternating-current component is reduced or removed from the normal operation if the resistance control unit is under the high mode and the toner's charge amount represented by the obtained charge amount signal is equal to or more than a predetermined supreme limit charge amount which is further higher than the upper limit charge amount.

7. The developing device according to claim 6, wherein the developing bias power source is configured to apply the developing bias in which the alternating-current component is removed or reduced from the normal operation only if an image to be formed is a line drawing.

8. The developing device according to claim 3 comprising an ammeter to measure a value of current flowing in the variable resistance unit and an image density sensor to measure an image density of an image developed and formed by the developing roller, wherein the resistance control unit is configured to:

vary the resistance value of the variable resistance unit to a plurality of levels so that an image forming operation and measurement of an image density are performed at each of the levels to obtain a current table representing a relationship between the resistance value of the variable resistance unit and a total amount of current flowing in the variable resistance unit during developing;

read out a developing current which is the smallest value among total current values in the current table, the developing current flowing in association with movement of the toner from the developing roller to the image carrier during developing and designate an image density of the image formed when the current value of the developing current is obtained as a selected image density;

obtain the charge amount signal from an electric charge corresponding to the developing current and a toner amount corresponding to the selected image density;

calculate excess current as a current amount corresponding to an excess amount of a toner's charge amount represented by the obtained charge amount signal with respect to a predetermined upper limit charge amount of the toner;

read out a resistance value of the variable resistance unit from the current table so that the total current is a value calculated by subtracting the excess current value from a current value obtained for the smallest resistance value of the variable resistance unit; and adjust subsequent resistance value of the variable resistance unit to the read-out value so that the high mode is set.

9. The developing unit according to claim 8, wherein the resistance control unit is configured to:

adjust the resistance value of the variable resistance unit to be the read-out value only if the toner's charge amount represented by the obtained charge amount signal exceeds the upper limit charge amount; and set the resistance value of the variable resistance unit to be the smallest value within a variable range which is the low mode if the toner's charge amount represented by the obtained charge amount signal is equal to or less than the upper limited charge amount.

10. The developing device according to claim 1, wherein the resistance control unit is configured to:

apply the low mode in a normal operation;

switch to the high mode when a predetermined charge-up situation occurs, the charge-up situation indicating that the toner's charge amount is increased; and return to the low mode when a predetermined charge-down situation occurs, the charge-down situation indicating that the toner charge amount is decreased after the switching from the low mode to the high mode is done.

11. The developing device according to claim 1, wherein the developing bias power source is configured to:

apply a developing bias in which an alternating-current component is superimposed with a direct-count component in a normal operation; and apply a developing bias in which the alternating-current component is reduced or removed from the normal operation if the resistance control unit is under the high mode.

12. The developing device according to claim 11, wherein the developing bias power source is configured to apply the developing bias in which the alternating-current component is removed or reduced from the normal operation only if an image to be formed is a line drawing.

13. The developing device according to claim 1, wherein the maximum resistance value of the variable resistance unit is within a range of 10 to 150 (MΩ).

14. An image forming apparatus comprising:

a photoconductor;

an exposing unit to form a latent image on a surface layer of the photoconductor; and a developing device to develop the latent image formed on the photoconductor by use of toner, wherein the developing device is the one described in claim 1.

15. The image forming apparatus according to claim 14, wherein the variable resistance unit includes:

a fixed resistor;

a bypass path bypassing the fixed resistor; and a switch to selectively make operative any one of the fixed resistor and the bypass path, and the resistance control unit is configured to control the switch to:

make operative the bypass path in the low mode; and make operative the fixed resistor in the high mode.

16. The image forming apparatus according to claim 14, wherein the variable resistance unit includes a variable resistor, and the resistance control unit is configured to:

control the resistance value of the variable resistance unit to be a smallest value in the low mode; and control the resistance value of the variable resistance unit to be an enhanced value which is larger than the smallest value and to be larger when a toner's charge amount represented by the charge amount signal is higher in the high mode.

17. The image forming apparatus according to claim 16, comprising an ammeter to measure a value of current flowing in the variable resistance unit, wherein the resistance control unit is configured to:

obtain a current table representing a relationship between the resistance value of the variable resistance unit and a total amount of current flowing in the variable resistance unit during developing by varying the resistance value of the variable resistance unit to a plurality of levels and performing an image forming operation with a fixed image density at each of the levels;

read out a developing current which is the smallest value among total current values in the current table, the developing current flowing in association with movement of the toner from the developing roller to the image carrier during developing;

obtain the charge amount signal based on an electric charge corresponding to the developing current and a toner amount corresponding to an image density of a formed image;

obtain excess current as a current amount corresponding to an excess amount of the toner's charge amount represented by the obtained charge amount signal with respect to a predetermined upper limit charge amount of the toner;

read out a resistance value of the variable resistance unit from the current table so that the total current is a value calculated by subtracting the excess current value from a current value obtained for the smallest resistance value of the variable resistance unit, and adjust subsequent resistance values of the variable resistance unit to the read-out value so that the high mode is set.

18. The image forming apparatus according to claim 17, wherein the resistance control unit is configured to:

adjust the resistance value of the variable resistance unit to be the read-out value only if the toner's charge amount represented by the obtained charge amount signal exceeds the upper limit charge amount; and set the resistance value of the variable resistance unit to be the smallest value within a variable range which is the low mode if the toner's charge amount represented by the obtained charge amount signal is equal to or less than the upper limited charge amount.

19. The image forming apparatus according to claim 16, comprising an ammeter to measure a value of current flowing in the variable resistance unit and an image density sensor to measure an image density of an image developed and formed by the developing roller, wherein the resistance control unit is configured to:

vary the resistance value of the variable resistance unit to a plurality of levels so that an image forming operation and measurement of an image density are performed at each of the levels to obtain a current table representing a relationship between the resistance value of the variable resistance unit and a total amount of current flowing in the variable resistance unit during developing;

read out a developing current which is the smallest value among total current values in the current table, the developing current flowing in association with movement of the toner from the developing roller to the image carrier during developing and designate an image density of the image formed when the current value of the developing current is obtained as a selected image density;

obtain the charge amount signal from an electric charge corresponding to the developing current and a toner amount corresponding to the selected image density;

calculate excess current as a current amount corresponding to an excess amount of a toner's charge amount represented by the obtained charge amount signal with respect to a predetermined upper limit charge amount of the toner;

read out a resistance value of the variable resistance unit from the current table so that the total current is a value calculated by subtracting the excess current value from a current value obtained for the smallest resistance value of the variable resistance unit; and adjust subsequent resistance value of the variable resistance unit to the read-out value so that the high mode is set.

20. The image forming apparatus according to claim 14, wherein the resistance control unit is configured to:

apply the low mode in a normal operation;

switch to the high mode when a predetermined charge-up situation occurs, the charge-up situation indicating that the toner's charge amount is increased; and return to the low mode when a predetermined charge-down situation occurs, the charge-down situation indicating that the toner charge amount is decreased after the switching from the low mode to the high mode is done.

* * * * *